US007470242B2

(12) United States Patent
Ferber et al.

(10) Patent No.: US 7,470,242 B2
(45) **Date of Patent: *Dec. 30, 2008**

(54) PORTABLE BODY MASSAGER HAVING WIDTH ADJUSTABLE MASSAGE MEMBERS ON TRANSLATING CARRIAGE

(75) Inventors: Roman Ferber, West Bloomfield, MI (US); Stephen Chung, Taipei (TW)

(73) Assignee: FKA Distributing Co., Commerce Township, MI (US)

( * ) Notice: Subject to any disclaimer, the term of this patent is extended or adjusted under 35 U.S.C. 154(b) by 125 days.

This patent is subject to a terminal disclaimer.

(21) Appl. No.: 11/205,949

(22) Filed: Aug. 17, 2005

(65) Prior Publication Data

US 2006/0211962 A1 Sep. 21, 2006

Related U.S. Application Data

(63) Continuation of application No. 11/084,289, filed on Mar. 18, 2005, now abandoned.

(51) Int. Cl.
*A61H 15/00* (2006.01)

(52) U.S. Cl. ..... 601/100; 601/103; 601/112

(58) Field of Classification Search ..... 601/100, 601/101, 103, 49, 56–60, 84–57, 90, 91, 601/93, 94, 97–99, 112, 113, 115, 116, 121, 601/126, 127, 133, 134, 136
See application file for complete search history.

(56) References Cited

U.S. PATENT DOCUMENTS 3,001,523 A 9/1961 Sugimoto
3,374,784 A 3/1968 Brent et al.
3,633,571 A 1/1972 Shinagawa
4,167,182 A 9/1979 Yamamura et al.
4,373,516 A 2/1983 Masuda et al.
4,412,534 A 11/1983 Hamabe et al.
4,422,448 A 12/1983 Sugai et al.
4,422,449 A 12/1983 Hamabe
4,491,127 A 1/1985 Yamamura et al.
4,505,267 A 3/1985 Inada (Continued)

FOREIGN PATENT DOCUMENTS

DE 9312157 U1 10/1993

(Continued)

OTHER PUBLICATIONS

International Search Report for corresponding International Application No. PCT/US06/09892, mailed Aug. 7, 2007, 8 pages.

(Continued)

*Primary Examiner*—Danton DeMille
(74) *Attorney, Agent, or Firm*—Brooks Kushman P.C.

(57) ABSTRACT

The present invention discloses a body massager comprising a portable housing including a backrest and a seat support. A longitudinal guide is provided in the backrest cooperating with a carriage for translation of the carriage within the backrest and a motor drives the carriage along the guide. A pair of massage members are supported by the carriage and extend from the backrest for imparting a rolling massage effect upon the back of the user. A second motor drives the massage members for generating a rotary kneading massage effect or for adjusting a width of the rolling massage effect.

25 Claims, 5 Drawing Sheets

U.S. PATENT DOCUMENTS 4,574,786 A 3/1986 Hashimoto et al.
4,576,149 A 3/1986 Otuka et al.
4,686,967 A 8/1987 Hashimoto et al.
4,718,408 A 1/1988 Barreiro
4,777,940 A 10/1988 Yamasaki
4,785,798 A 11/1988 Yamasaki
5,020,518 A 6/1991 Spears et al.
5,063,911 A 11/1991 Teranishi
5,179,940 A 1/1993 Barreiro
5,183,034 A 2/1993 Yamasaki et al.
5,233,973 A 8/1993 Gill et al.
5,265,590 A 11/1993 Takagi
5,305,738 A 4/1994 Shimizu
5,356,369 A 10/1994 Yamasaki et al.
5,460,598 A 10/1995 Yamasaki et al.
5,462,516 A 10/1995 Anderson
5,464,382 A 11/1995 Wang
5,630,790 A 5/1997 Ito
5,685,827 A 11/1997 Shimizu
5,755,677 A 5/1998 Masuda et al.
5,785,668 A 7/1998 Shimizu
5,792,080 A 8/1998 Ookawa et al.
5,807,288 A 9/1998 Wu
6,056,708 A 5/2000 Sayama et al.
6,083,180 A 7/2000 Shimizu
6,200,282 B1 3/2001 Furuie et al.
6,213,962 B1 4/2001 Shimizu
6,224,563 B1 5/2001 Nonoue et al.
6,283,928 B1 9/2001 Wang
6,312,400 B1 11/2001 Itikawa et al.
6,402,709 B1 * 6/2002 Wu ..... 601/98
6,443,917 B1 9/2002 Canto
6,503,212 B2 1/2003 Park
6,511,448 B1 1/2003 Furuie et al.
6,517,500 B2 2/2003 Ichikawa
6,629,939 B2 10/2003 Jikiba et al.
6,656,140 B2 12/2003 Oguma et al.
6,749,577 B2 6/2004 Kume et al.
6,790,190 B2 9/2004 Marcantoni
6,805,680 B2 10/2004 Klingler
6,808,500 B1 10/2004 Cheng-Yi et al.
6,814,710 B1 11/2004 Dehli
6,832,991 B1 12/2004 Inada et al.
6,837,861 B2 1/2005 Lin
6,840,914 B1 1/2005 Takamura
6,849,054 B1 2/2005 Kim
6,866,644 B1 3/2005 Kost
6,890,313 B2 5/2005 Kim
6,899,688 B2 5/2005 Wu
6,911,012 B2 6/2005 Kahn
6,916,300 B2 7/2005 Hester et al.
2002/0138023 A1 9/2002 Kume et al.
2002/0156404 A1 10/2002 Kuo
2003/0009117 A1 1/2003 Zou
2003/0018284 A1 1/2003 Lim
2003/0032903 A1 2/2003 Kasai
2003/0060741 A1 3/2003 Park
2003/0120187 A1 6/2003 Kan et al.
2003/0199796 A1 10/2003 Yamazaki et al.
2003/0212353 A1 * 11/2003 Kahn ..... 601/99
2003/0212354 A1 11/2003 Kahn
2003/0216673 A1 11/2003 Miki et al.
2003/0216674 A1 11/2003 Miki et al.
2003/0225351 A1 12/2003 Wu
2004/0049136 A1 * 3/2004 Lin ..... 601/86
2004/0082889 A1 4/2004 Wu
2004/0097851 A1 5/2004 Inada et al.
2004/0106882 A1 * 6/2004 Tseng ..... 601/86
2004/0122343 A1 6/2004 Mori et al.
2004/0127823 A1 7/2004 Mori et al.
2004/0158176 A1 8/2004 Park
2004/0158180 A1 8/2004 Liang
2004/0171972 A1 9/2004 Shimizu et al.
2004/0183345 A1 9/2004 Furuie et al.
2004/0186398 A1 9/2004 Furuie
2004/0210174 A1 10/2004 Kim
2004/0211015 A1 10/2004 Chen
2004/0225240 A1 11/2004 Kim
2004/0230145 A1 11/2004 Kim
2004/0236256 A1 11/2004 Kim
2004/0243030 A1 12/2004 Tanizawa et al.
2004/0243033 A1 12/2004 Kim
2004/0243034 A1 12/2004 Kim
2004/0249321 A1 12/2004 Grueger et al.
2004/0260215 A1 * 12/2004 Kim ..... 601/99
2005/0010142 A1 1/2005 Kim
2005/0010143 A1 1/2005 Kim
2005/0010144 A1 1/2005 Chen
2005/0015029 A1 1/2005 Kim
2005/0033204 A1 2/2005 Nakamura et al.
2005/0049530 A1 3/2005 Kim
2005/0049531 A1 3/2005 Kim
2005/0080365 A1 * 4/2005 Wu et al. ..... 601/98
2005/0090770 A1 4/2005 Chen
2005/0090771 A1 4/2005 Miki
2005/0096571 A1 5/2005 Miki
2005/0101890 A1 5/2005 Mizoguchi et al.
2005/0124921 A1 6/2005 Tseng
2005/0137503 A1 6/2005 Hori et al.
2005/0148912 A1 7/2005 Liao
2005/0245851 A1 11/2005 Ferber et al.
2005/0256434 A1 * 11/2005 Luo ..... 601/86
2007/0299379 A1 12/2007 Luo

FOREIGN PATENT DOCUMENTS

EP 1000600 A1 5/2000
EP 1208834 A1 5/2002
EP 1400230 A1 9/2002
GB 2123298 A 2/1984
GB 2267440 A 12/1993
JP S5086889 7/1975
JP S56119251 A 9/1981
JP S5928963 A 2/1984
JP S60135122 U 9/1985
JP S06209974 A 8/1994
JP S07080035 A 3/1995
JP H10216187 A 8/1998
JP 2000262575 A 9/2000
JP 2001017494 A 1/2001
JP 2001029419 A 2/2001
JP 2001314470 A 11/2001
JP 2001314471 A 11/2001
JP 2002063155 A 9/2002
JP 2003038591 A 2/2003
WO 9959516 A1 11/1999
WO 02069880 A1 9/2002

OTHER PUBLICATIONS

Dr. Scholl's, Look. Feel. Do. Better., 2003, Helen of Troy.
U.S. Office Action for U.S. Appl. No. 11/625,255, mailed Nov. 15, 2007, 8 pages.
HoMedics, Shiatsu Massaging Cushion, Moving Massage Mechanism, SBM-200, Instruction Manual and Warranty Information, 2003-2005 HoMedics, Inc., and Figures from Ferber et al. US 7,128,721 B2, 20 pages.
European Search Report for corresponding application No. 06748449.3, mailed Aug. 7, 2008, and pending claims, 9 pages.

* cited by examiner

PORTABLE BODY MASSAGER HAVING WIDTH ADJUSTABLE MASSAGE MEMBERS ON TRANSLATING CARRIAGE

CROSS-REFERENCE TO RELATED APPLICATIONS

This application is a continuation of U.S. application Ser. No. 11/084,289; filed Mar. 18, 2005 now abandoned.

BACKGROUND OF THE INVENTION

1. Field of the Invention

The present invention relates to massagers, particularly to portable body massagers.

2. Background Art

The prior art includes body massagers provided within chairs, as well as in portable cushions. These prior art body massagers commonly include a track or guide for moving a massage assembly longitudinally within the chair or cushion. The prior art body massagers are relatively complex and utilize many components, thereby requiring sufficient structure to support the massager and limiting the portability of the massager. Due to the complexities of conventional body massagers, a consumer's ability to procure such massagers is limited due to value and affordability.

For example, many prior art body massagers include a complex guide system and frame thereby requiring a housing that is sufficiently robust, such as a chair. Accordingly, these drawbacks of the prior art add both cost and weight to the prior art body massagers.

A goal of the present invention is to provide a simplified body massager having improvements in massage function, portability and cost in view of the prior art.

SUMMARY OF THE INVENTION

An aspect of the present invention is to provide a body massager comprising a portable housing having an external contact surface for receiving a portion of a body of a user. A longitudinal guide is mounted in the housing; a carriage is oriented in the housing and cooperates with the guide for limited longitudinal translation. A motor is supported by the carriage or the housing for translating the carriage along the guide. A pair of massage members are supported by the carriage for rotation relative to the carriage for providing a massage effect to the user. A width of the massage members is adjustable by the rotation of the massage members relative to the carriage.

Another aspect of the present invention is to provide a second motor in operable communication with the massage members for rotating the members relative to the carriage.

A further aspect of the present invention is wherein the user can control the operation of the first and second motors to provide a rolling massage effect resulting from continuous operation of the first motor. The rolling massage effect can be provided with width adjustment resulting from user selective operation of the second motor. A rotary kneading massage effect can be provided from continuous operation of the second motor. Longitudinal adjustment of the rotary kneading massage effect may be provided from a user selected operation of the first motor. A rotary kneading massage effect upon the length of the user's body can be provided from continuous operation of the first and second motors.

The above aspects and other aspects, objects, features, and advantages of the present invention are readily apparent from the following detailed description of the preferred embodiment for carrying out the invention when taken in connection with the accompanying brief description of the drawings.

DETAILED DESCRIPTION OF EMBODIMENTS OF THE INVENTION

Figure 1:
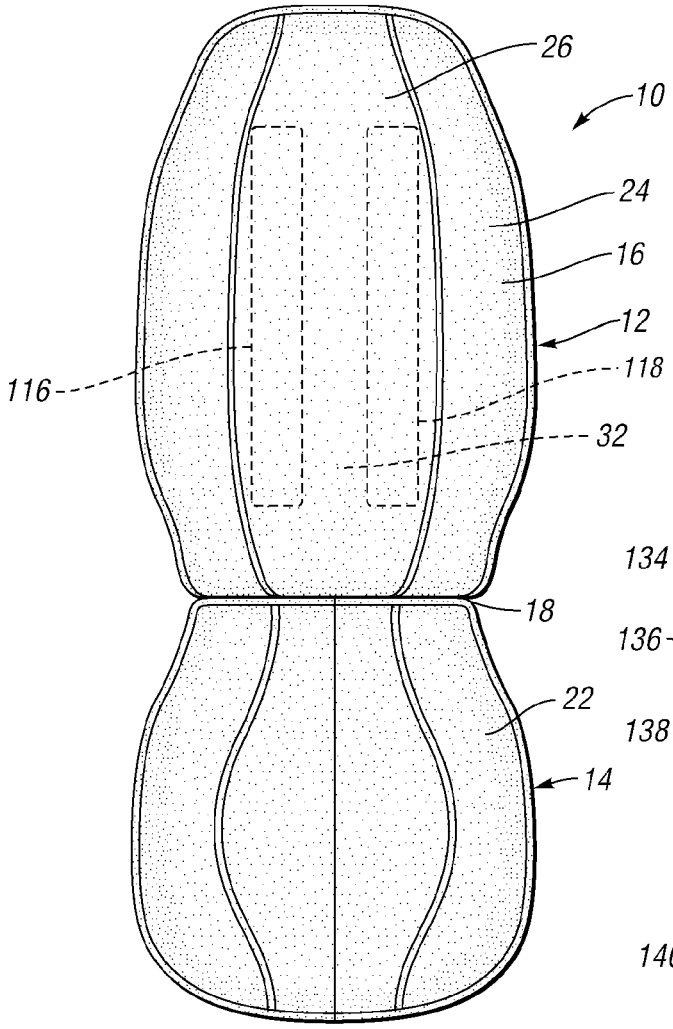
FIG. 1 is an elevation view of a portable body massager in accordance with the present invention.

With reference to FIG. 1, an exemplary embodiment body massager is illustrated in accordance with the present invention and is referenced generally by numeral 10. The body massager 10 includes a backrest region 12 and a seat support region 14. The internal assemblies of the backrest region 12 and the seat support region 14 are collectively retained within a flexible cover 16, which is formed of a high quality vinyl. Of course other materials such as leather may be employed for the cover 16. The cover 16 provides a pivotal connection 18 at a lower longitudinal end of the backrest region 12 and a rearmost end of the seat support region 14. The flexible material of the cover 16 provides a living hinge at the pivotal connection 18 permitting user adjustment of an included angle between the backrest region 12 and the seat support region 14.

Massage effects provided by the body massager 10 include a rolling massage effect and a kneading massage effect provided in the backrest support 12, which is operable to provide the massage effects longitudinally along the length of the backrest region 12. The seat support region 14 provides a vibratory massage effect to the user seated thereupon.

The backrest region 12 is sized to be received upon a backrest of a conventional chair. Likewise, the seat support region 14 is sized to be received upon a seat support of a conventional chair. Additionally, the body massager 10 is portable due to its compact size and light weight so that the user may place the body massager 10 upon a conventional chair for receiving a massage when seated upon the chair. The adjustability of the included angle between the backrest region 12 and the seat support region 14 accommodates a wide range of angles that may be incorporated in conventional chairs.

The backrest region 12 includes a height and width corresponding to the conventional chair and has a thickness that is adequate for housing the massager assembly therein while avoiding disruption of comfort, and support provided by the underlying chair. For example, the height of the backrest region 12 may be 650 millimeters, and the width may be 430 millimeters.

Likewise, the seat support region 14 has a width and a depth corresponding to that of the conventional seat support and has a thickness that is adequate for housing the associated massager assembly while avoiding disruption of comfort and support provided by the underlying chair. For example, the seat support region 14 width may be 430 millimeters and the depth may 455 millimeters. Of course, the invention contemplates that the body massager may have dimensions adequate to be received by any conventional chair. However, the dimensions of the preferred embodiment are suitable for most conventional chairs.

Additionally, the backrest region 12 may includes a pair of straps mounted from its lateral sides for securing the body massager 10 to the conventional chair, such as the straps disclosed in U.S. patent application Ser. No. 10/836,905, filed on Apr. 30, 2004, titled Portable Body Massager, which is incorporated in its entirety by reference herein.

The seat support region 14 includes a seating surface 22 provided thereon for receiving the user when seated. The backrest region 12 includes a backrest surface 24 for receiving and supporting the back of the user thereupon. The massage assemblies of the backrest region 12 and the seat support region 14 impart the respective massage effects through the backrest surface 24 and seating surface 22 respectively.

Figure 2:
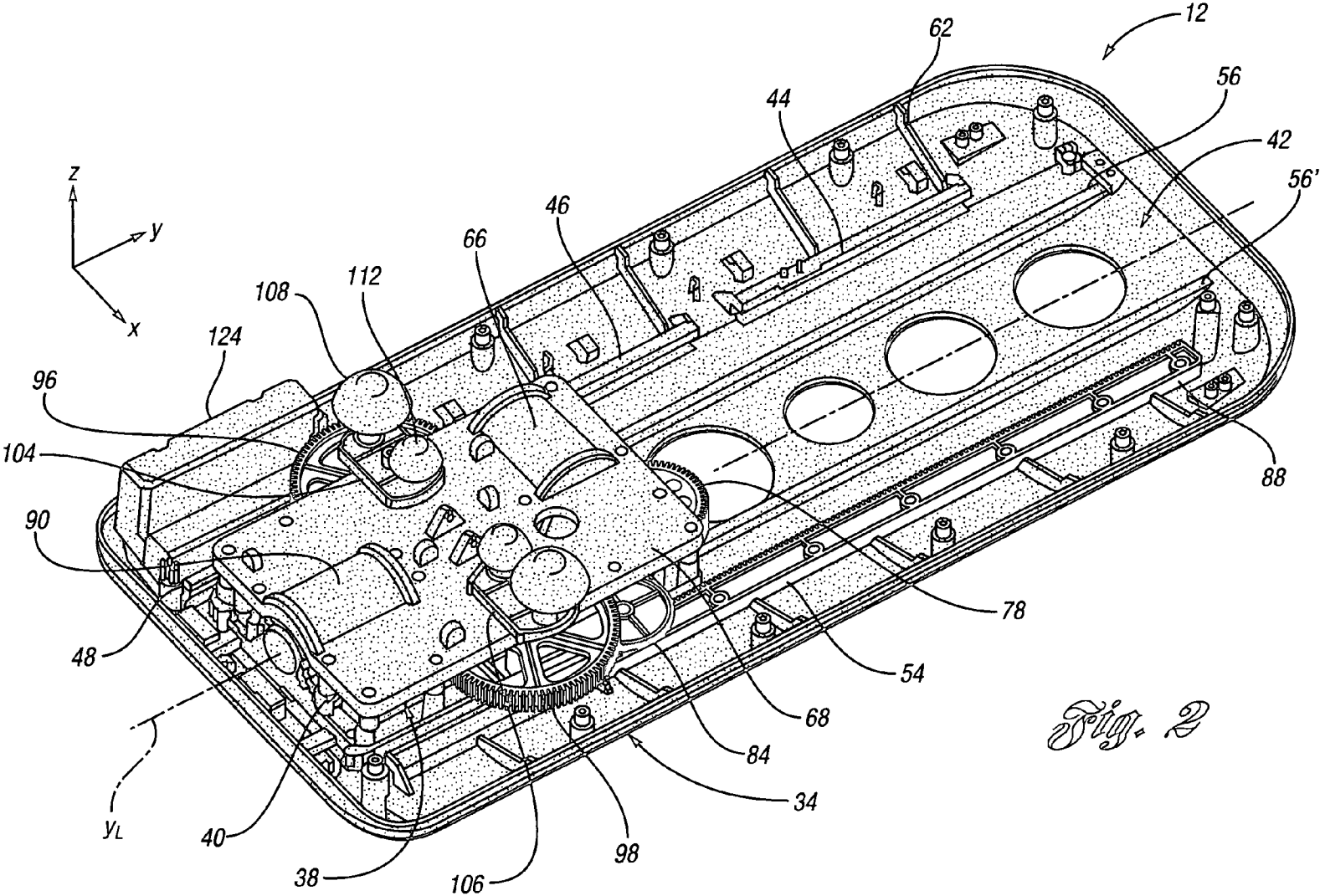
FIG. 2 is a perspective view of a backrest region of the body massager of FIG. 1, illustrated with a portion of a housing partially removed.

The backrest region 12 includes a two piece housing provided by an upper housing portion 32 (FIG. 1) and a lower housing portion 34 (FIG. 2). The upper housing portion 32 and the lower housing portion 34 are sized and adaptable to be secured together by a plurality of fasteners for retaining components of a massager assembly 38 therein.

Referring now to FIG. 2, the massage assembly 38 includes a carriage 40 which cooperates with the lower housing portion 34 for limited longitudinal translation within the backrest region 12. Accordingly, the lower housing portion 34 includes a longitudinal guide 42 mounted therein for cooperating with the carriage 40. The longitudinal direction y is illustrated in FIG. 2 and the housing includes a longitudinal axis $y_L$. The guide 42 includes a series of gibs indicated and referenced as upper gib 44, central gib 46 and lower gib 48. The gibs 44, 46, 48 of the lower housing portion 34 cooperate with and retain a first longitudinal key 50 formed laterally along the carriage 40. The carriage 40 includes a second longitudinal key 52 formed laterally thereupon in transversely spaced opposition to that of the first key 50. A transverse direction x is illustrated in FIG. 2. The second key 52 is retained relative to the lower housing portion 34 by an elongate retainer gib 54 which is secured to the lower housing portion 34 by a series of fasteners.

Figure 3:
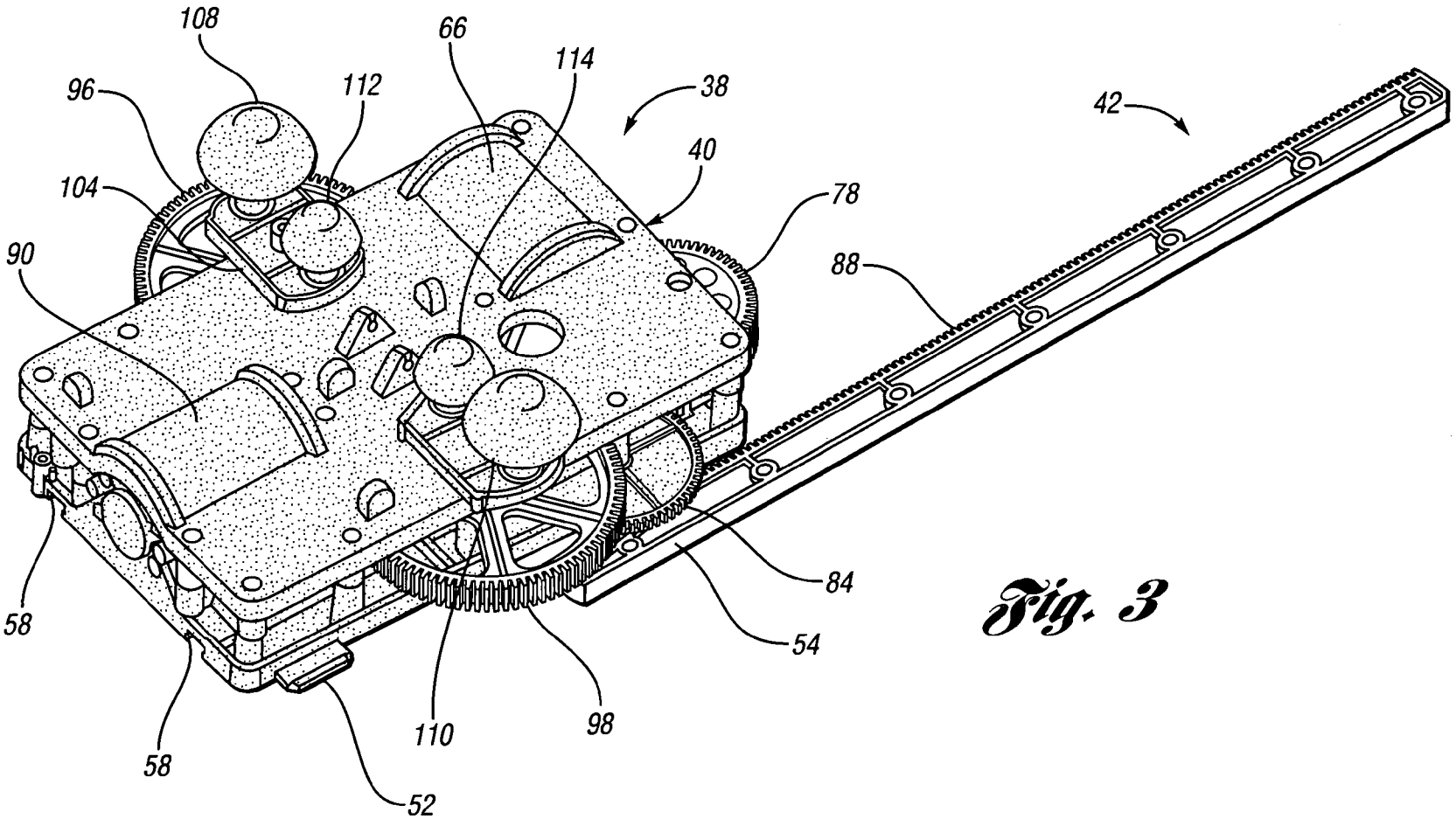
FIG. 3 is an enlarged perspective view of a carriage and a portion of a guide of the body massager of FIG. 1.
Figure 5:
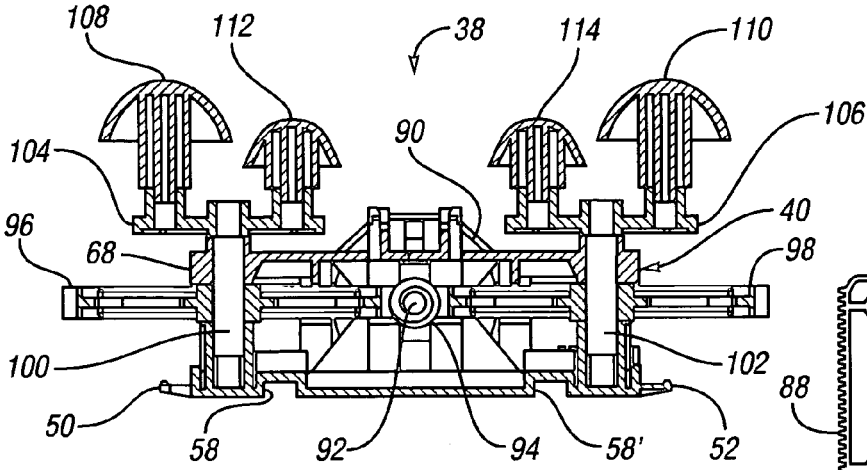
FIG. 5 is a partial section view of the carriage of the body massager of FIG. 1.
Figure 4:
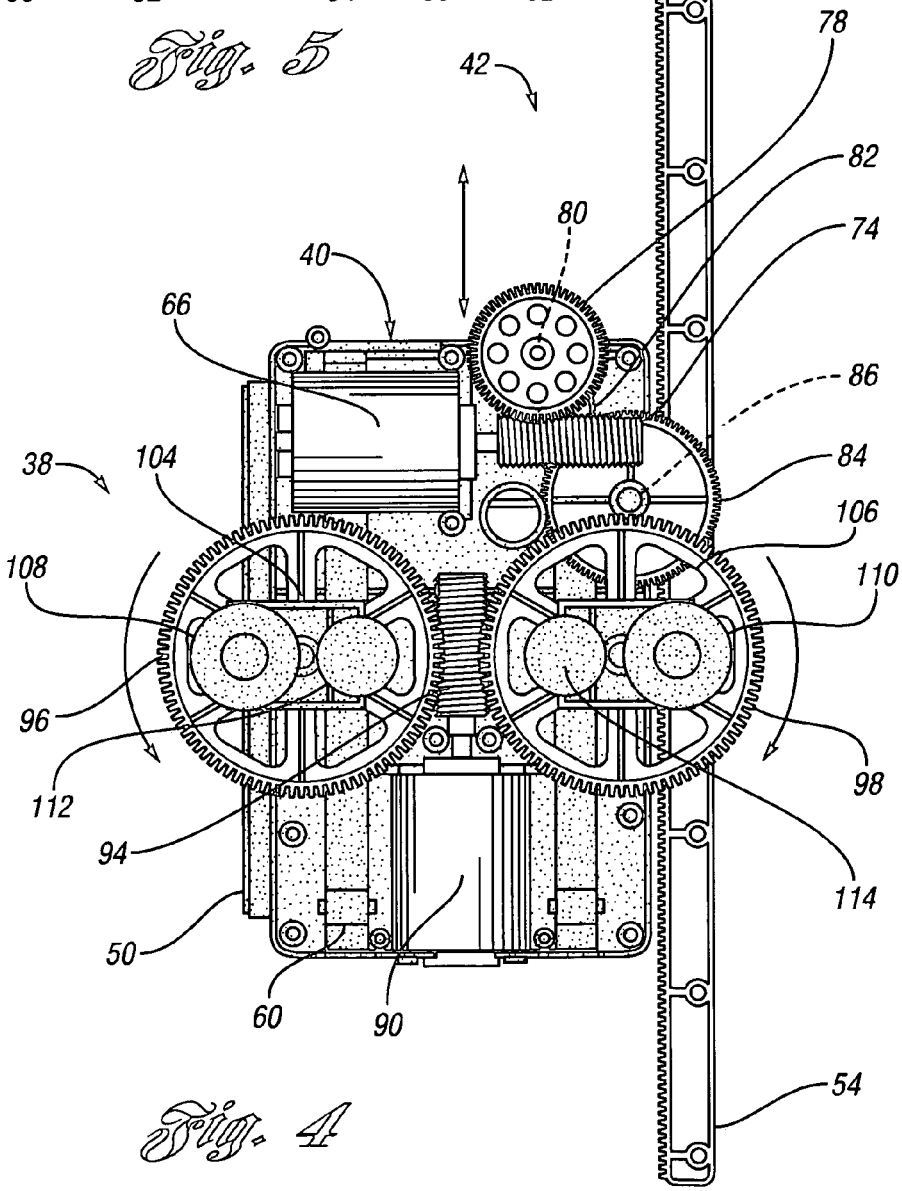
FIG. 4 is a top plan view of the carriage and the guide portion of the body massager of FIG. 1, illustrated with a cover plate removed from the carriage.
Figure 6:
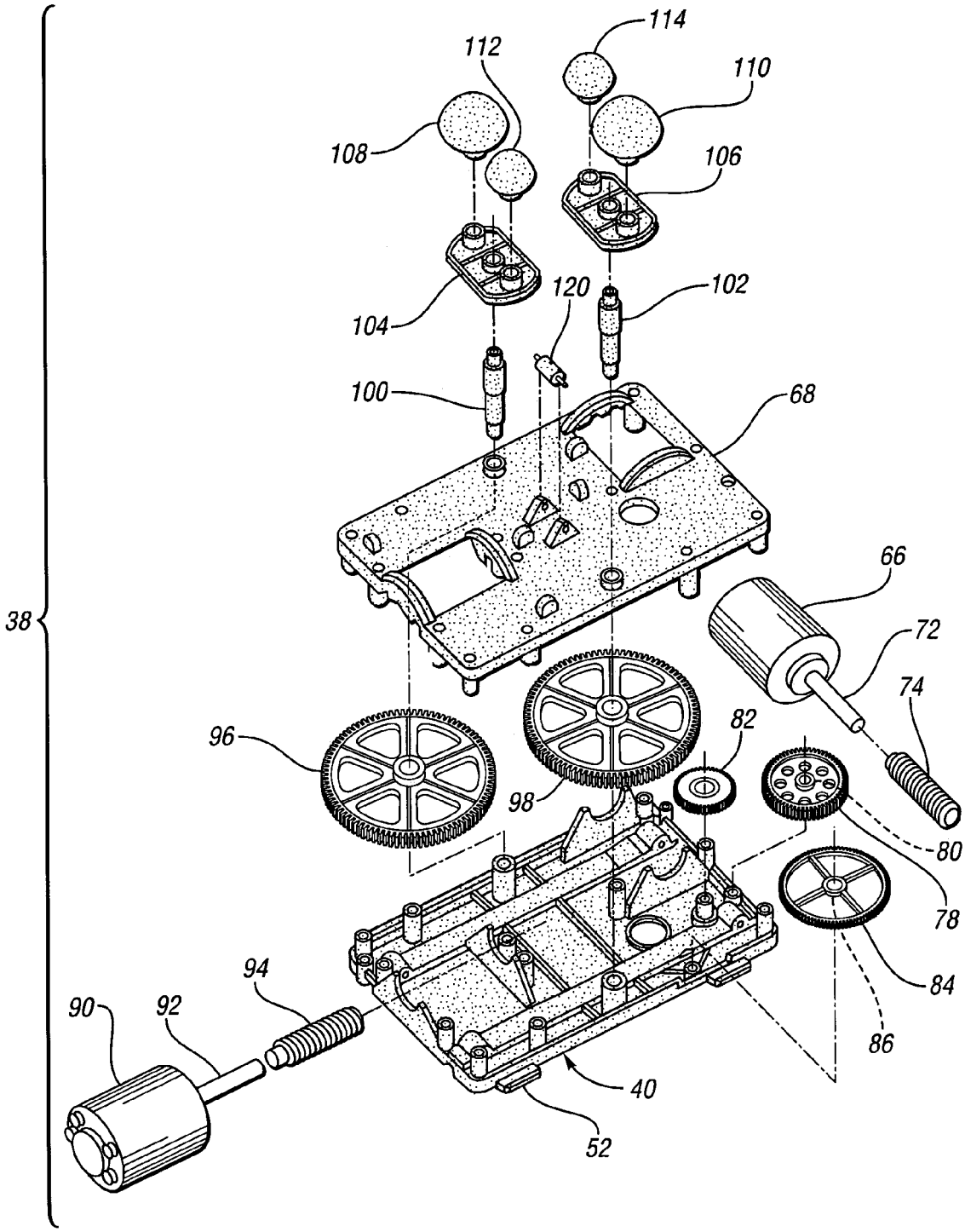
FIG. 6 is an exploded perspective view of the carriage of the body massager of FIG. 1.

The guide 42 of the lower housing portion 34 further comprises a pair of longitudinal rails 56, 56' provided within the lower housing portion 34 and extending upward therefrom. A pair of keyways 58, 58' (FIG. 3) are formed longitudinally through the carriage 40. The keyways 58, 58' are sized to receive the rails 56, 56', respectively. The cooperation of the rails 56, 56' and keyways 58, 58' provides transverse guidance and support to the carriage 40 as it translates along the guide 42. The carriage 40 includes a plurality of roller bearings 60 (FIG. 4), which are each pivotally connected to the carriage 40 and are offset from the keyways 58, 58' and adjacent thereto for engaging a bearing surface provide upon each rail 56, 56'. As the carriage 40 translates along the guide 42, the carriage 40 is bearingly supported by the roller bearings 60 as they engage the surfaces provided by the rails 56, 56'.

With reference again to FIG. 2, the lower housing portion 34 includes a series of ribs 62 formed therein for providing cross support to the lower housing portion 34 and the gibs 44, 46, 48, 54. Accordingly, the two piece housing 32, 34 provides both a housing and a structural frame for the massager assembly 38. Both housing portions 32, 34 are each formed from an injection molding process or the like to provide low weight, yet rigid structural members. Additionally, the upper gib 44, central gib 46, lower gib 48 and rails 56, 56' are integrally formed with the lower housing portion 34 thereby enhancing rigidity and structural cooperation therebetween and minimizing costs in components and assembly.

With reference now to FIGS. 3-6, the massage assembly 38 is illustrated in greater detail. The massage assembly 38 includes a first motor 66, which is mounted to the carriage 40 and retained by a cover plate 68. The cover plate 68 and the carriage 40 collectively define a motor mount for the first motor 66 and are fastened together by a plurality of fasteners. The first motor 66 is operable to translate the carriage 40 along the guide 42 of the lower housing portion 34. The first motor 66 includes a motor output shaft 72 extending from the first motor 66 and driven thereby. A worm 74 is provided on the motor output shaft 72 and fixed relative to the shaft 72. The worm 74 drives a worm gear 78 that is mounted to the carriage 40 for rotation relative to the carriage 40.

A first pinion gear 80 is mounted to the underside of the worm gear 78 and is driven thereby. A first reduction gear 82 is rotatably mounted upon the carriage 40 for rotation about an axis in the z direction. The first reduction gear 82 is engaged with a second reduction gear 84. The second reduction gear 84 is rotatably coupled to the carriage 40 for rotation about an axis in the z direction. A second pinion gear 86 is secured to the underside of the second reduction gear 84. The second pinion gear 86 is engaged to a gear rack 88 formed along the retainer gib 54.

The worm 74, worm gear 78, first pinion gear 80, first reduction gear 82, second reduction gear 84, second pinion gear 86 and gear rack 88 provide a transmission such that rotation from the motor output shaft 72 experiences three stages of reduction for reduced rotation of the second pinion gear 86 relative to the motor output shaft 72. Since the rack 88 is fixed relative to the guide 42, rotation of the second pinion gear 86 translates the carriage 40 along the guide 42. Accordingly, the rotation of the motor output shaft 72 results in translation of the carriage along the guide 42 due to the engagement with the gear rack 88.

The massage assembly 38 also includes a second motor 90, which is mounted to the carriage 40 and retained by the cover plate 68. The cover plate 68 and the carriage 40 collectively define a motor mount for the second motor 90 and are fastened together by a plurality of fasteners. The second motor 90 is operable to impart a massage effect from the massage assembly 38. The second motor 90 includes a motor output shaft 92 extending from the second motor 90 and driven thereby. A worm 94 is provided on the motor output shaft 92 and fixed relative to the shaft 92. The worm 94 drives a pair of worm gears 96, 98 in opposed rotational directions. Each worm gear 96, 98 is secured to a gear shaft 100, 102. The gear shafts 100, 102 are each rotatably connected to the carriage 40 and the cover plate 68 so that the worm 94 drives the worm gears 96, 98 in opposite rotary directions relative one another in a reduced rotation from that of the second motor 90. The gear shafts 100, 102 extend in direction z, which is perpendicular to both the longitudinal direction y and the transverse direction x.

Each gear shaft 100, 102 extends through the cover plate 68 and receives a massage bracket 104, 106, which are each fastened to the respective gear shaft 100, 102. The massage brackets 104, 106 are transversely spaced about the longitudinal axis $y_L$. Each massage bracket 104, 106 includes a first massage hemispherical node 108, 110 and a second hemispherical massage node 112, 114 mounted to the respective bracket 104, 106.

The gear shafts 100, 102 are oriented perpendicular to the guide 42 and extend in the z direction towards the backrest surface 24. The massage nodes 108, 110, 112, 114 are each rotatable relative to the respective massage bracket 104, 106 about an axis that is offset from that of the respective gear shaft 100, 102. The massage nodes 108, 110, 112, 114 extend through a corresponding aperture 116, 118 (FIG. 1) formed through a central region 26 of the housing upper portion 32 for imparting the massage effect to the user through the cover 16. As the massage nodes 108, 110, 112, 114 revolve around the corresponding gear shaft 100, 102, a rotary kneading massage effect is imparted upon the user, which is commonly referred to as a Shiatsu massage.

Each massage node 108, 110, 112, 114 is rotatably connected to the corresponding massage bracket 104, 106 to reduce friction generated in the rotary kneading massage effect. Further, if the first motor 66 is in operation while the second motor 90 is not in operation, the massage nodes will be translated in engagement along the body part of the user. The rotatable connection permits the massage nodes 108, 110, 112, 114 to roll along the body part, thereby creating a rolling massage effect.

Additionally, the first massage nodes 108, 110 have an overall height in the z direction greater than that of the second massage nodes 112, 114 to extend further from the corresponding massage brackets 104, 106. The first massage nodes 108, 110 also have a diameter greater than that of the second massage nodes 112, 114. These variations are utilized for varying the engagement of the rotary kneading effect with the user, resulting in a kneading effect that is nonsymmetrical and similar to a massage provided by the hands of a skilled massage therapist. Additionally, these variations result in a nonsymmetrical rolling massage effect as the nodes 108, 110, 112, 114 are rolled along the body.

The apertures 116, 118 formed through the upper housing portion 32 are generally elongate for permitting the massage nodes 108, 110, 112, 114 to pass therethrough as the carriage 40 is translated relative to the guide 42. Further, the cover plate 68 includes a roller bearing 120 (FIG. 6) pivotally connected thereto for engaging an underside bearing surface formed within the upper housing portion 32, thus providing bearing support between the carriage 40 and the upper housing portion 32. Accordingly, loading imparted upon the backrest surface 24 is translated through the upper housing portion 32 to the carriage 40 through the roller bearing 120, to the lower housing portion 34 through the roller bearings 60 for providing bearing support therebetween and preventing such loading from inhibiting the translation of the carriage 40 along the guide 42.

Due to the translation of the carriage 40 and the first and second motors 66, 90, cord management may be necessary to ensure that a power cord, which provides power to the first and motors 66, 90 does not interfere with, nor get damaged by the operations of the massage assembly 38. Accordingly, a longitudinal bar may be provided within the backrest region 12 mounted to the lower housing portion 34 as disclosed in the U.S. patent application Ser. No. 10/836,905, which was incorporated by reference. The power cord is coiled about the bar for extension and retraction thereabout as the carriage 40 is translated along the guide 42.

The first motor 66 is directly coupled to the associated transmission for translation of the carriage 40 when the first motor 66 is powered. In order to reverse direction of the carriage 40, the rotational direction of the first motor 66 is reversed as well. In order to control the reversal of power to the first motor 66, a series of limit switches are provided along the guide 42. Limit switches, and the placement and operation of the limit switches are disclosed in U.S. patent application Ser. No. 10/836,905, which has been incorporated by reference herein. The signals provided by the limit switches are processed by a central processing unit provided at a circuit board 124, mounted within the backrest region 12 to the lower housing portion 34 as illustrated in FIG. 2.

Figure 7:
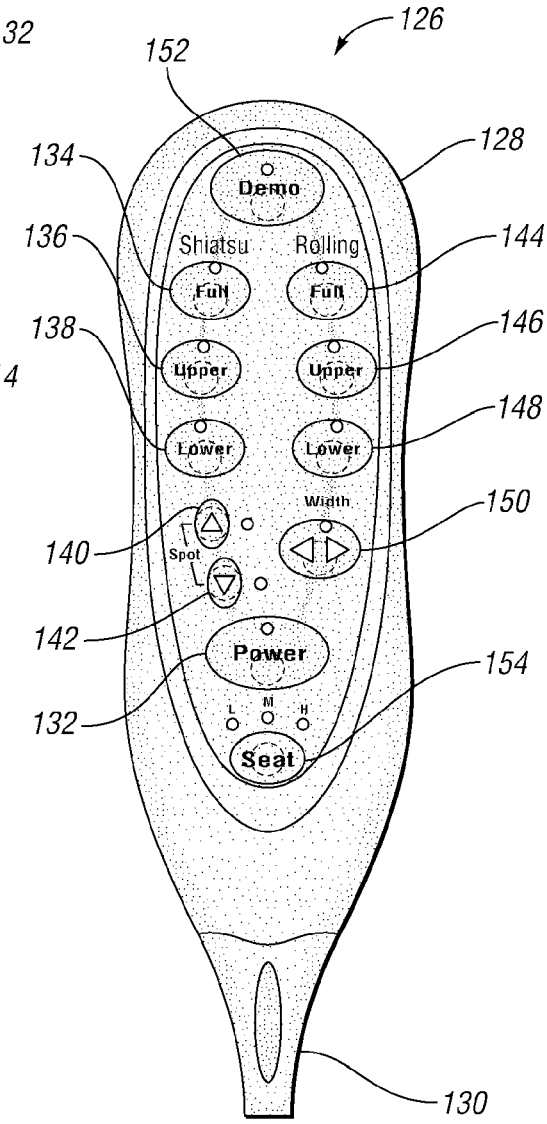
FIG. 7 is an elevation view of a remote control for the body massager of FIG. 1.

The user operates the massage assembly 38 via a control pad provided on the body massager 10. Referring now to FIG. 7, a remote control 126 is provided as the control pad for controlling the operations. The remote control 126 includes a body 128 that is sized to be grasped by the user, and a tether 130, which secures the body 128 to the body massager 10 and is wired to the circuit board 124 for operable communication therewith.

The remote control includes a power button 132 for turning the body massager on and off. The remote control also includes controls for the rotary kneading massage effect and the rolling massage effect provided from the massage assembly 38. Each button includes an LED for indicating that the associated function is in operation.

A full rotary kneading (or Shiatsu) massage effect button 134 is provided for selecting a rotary kneading massage effect to the full longitudinal range of the guide 42. In this operation, the second motor 90 is driven continuously for imparting a continuous rotary kneading massage effect. Additionally the first motor 66 is driven continuously for continuous translation of the carriage 40 along the guide 42. Upon the carriage reaching a limit in the overall travel along the guide 42, a corresponding limit switch indicates that the limit has been reached and the circuit board 124 reverses the rotation of the first motor 66 so that the carriage 40 reverses its direction of travel along the guide 42.

An upper rotary kneading massage effect button 136 and a lower rotary kneading massage effect button 138 are also provided for controlling a rotary kneading massage effect to a targeted range as defined by the limit switches. In each of these ranges, the second motor 90 is driven continuously for providing a rotary kneading massage effect, and the first motor 66 is driven continuously for translating the carriage 40 within the range. Upon the carriage 40 reaching a limit within the range, the rotation of the first motor 66 is reversed thereby reversing the direction of the carriage 40.

The remote control 126 further includes an upward targeted rotary kneading massage effect button 140 and a lower targeted rotary kneading massage effect button 142 for providing the rotary kneading massage effect to a targeted point upon the user's body. Upon actuation of one of these buttons 140, 142, the second motor 90 is driven continuously for providing a continuous rotary kneading massage effect. As either of these buttons 140, 142 is depressed by the user, the first motor 66 is driven in a direction corresponding to the depressed button 140, 142 for translating the carriage 40 to a user selected orientation. Upon reaching the user selected position, the user removes his or her finger from the button 140, 142 thereby discontinuing operation of the first motor 66 so that the carriage 40 stops at the selected position; and the second motor 90 continues to drive the rotary kneading massage effect.

A full rolling massage effect button 144 is provided on the remote control 126 for providing a full rolling massage effect. For this effect, the first motor 66 is driven continuously and the second motor 90 is not driven so that the nodes 108, 110, 112, 114 are stationary in orientation relative to the carriage 40 for rolling relative to the carriage 40 for providing a rolling massage effect upon the body of the user. The first motor 66 is driven in a first rotary direction until the carriage 40 engages the limit within the range of travel. Upon reaching this limit, the rotation of the first motor 66 is reversed thereby reversing the direction of the carriage 40.

An upper rolling massage effect button 146 and a lower rolling massage effect button 148 are also provided for providing the rolling massage effect within a targeted range as set forth by the limit switches along the guide 42.

A bidirectional width adjustment button 150 is also provided on the remote control 126 so that as the user is experiencing a rolling massage effect, as selected by one of the rolling massage effect buttons 144, 146, 148, the user may adjust the width of the massage nodes 108, 110, 112, 114. Specifically, the width adjustment button 150 controls the operation of the second motor 90 for the user selected duration. Thus, if the user depresses the width adjustment button 150 in one direction, the second motor 90 is driven in a first rotary direction while the button 150 is depressed. Upon releasing the width adjustment button 150, the operation of the second motor 90 is discontinued. Additionally, by depressing the width adjustment button 150 in a second direction, the second motor 90 is driven in a reversed rotary direction.

The width adjustment button 150 permits the user to adjust the rotary orientation of the nodes 108, 110, 112, 114 as the carriage 40 is driven along the guide 42. This rotary adjustment of the orientation of the nodes 108, 110, 112, 114 thereby adjusts the rotary orientation of the nodes 108, 110, 112, 114, which consequently adjusts the width of the nodes 108, 110, 112, 114 relative to the longitudinal axis $y_L$.

The remote control 126 further includes a demo button 152 for providing a demonstration operation of various combinations of the massage effects provided by the kneading and rolling buttons 134, 136, 138, 140, 142, 144, 146, 148, 150 so that the user experiences a variety of massage effects.

Briefly, the massage effects are generated from the simplified massage assembly 38. Rotary kneading massage effects and width adjustment of rolling massage effects are both provided from a common motor by continuous or user selected rotation of the nodes 108, 110, 112, 114. Accordingly, width adjustment of the nodes 108, 110, 112, 114 is provided within the body massager 10 without limiting the portability and weight of the massager 10, and without requiring a third motor.

The remote control 126 also includes a seat massage button 154 for imparting a massage effect to the seat bottom region 14. As disclosed in U.S. patent application Ser. No. 10/836,905, vibratory massage assemblies may be provided within the seat support region 14. The seat massage button 154 may be depressed multiple times to change the operation between a low, medium and high magnitude of vibratory massage from the massage assemblies. The intensity of the vibratory massage is controlled by the speed of the motors. The demo button 152 may include demonstrative massage effects that include various amplitudes of vibratory massages from the seat support region 14.

In summary, the body massager 10 provides an efficient, portable, lightweight, sturdy massage apparatus which generates various types of massages to various areas of the body with operational variations thereof so that the user may experience a variety of massage effects or desired targeted massage effects, while minimizing the size and costs of the overall massager.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a first motor supported upon the carriage, the first motor having a motor output shaft driven thereby, the motor output shaft being operably coupled to the housing to translate the carriage along the guide;

at least a pair of massage members transversely spaced about the longitudinal axis, each of the at least a pair of massage members being supported by the carriage for rotation relative to the carriage for imparting a massage effect upon the portion of the user's body as the carriage is translated relative to the housing; and a second motor supported upon the carriage in operable communication with the at least a pair of massage members for rotating the at least a pair of massage members relative to the carriage for providing a rotary kneading effect to a targeted region of the user's body corresponding to the longitudinal orientation of the carriage and for user-selected rotation of the at least a pair of massage members relative to the carriage for providing width adjustment independent of translation of the carriage along the guide so that a user can select a stationary width of the at least a pair of massage members for imparting the massage effect.

2. The portable body massager of claim 1 wherein the width adjustment of the at least a pair of massage members is controlled from a control pad.

3. The portable body massager of claim 1 wherein each of the at least a pair of massage members further comprises:

a bracket rotatably mounted to the carriage;

a primary massage node rotatably mounted to the bracket about an axis of rotation that is not coaxial with an axis of rotation of the bracket, so that the primary massage node can rotate relative to the bracket to provide a rolling massage effect; and a secondary massage node rotatably mounted to the bracket about an axis of rotation that is not coaxial with the axis of rotation of the bracket and the axis of rotation of the primary massage node, so that the secondary massage node can rotate relative to the bracket to provide a rolling massage effect, the secondary massage node being smaller than the primary massage node so that the rolling massage effect of the secondary massage node differs from that of the primary massage node.

4. The portable body massager of claim 1 further comprising a multistage transmission driven by the first motor and cooperating with the housing for the translating the carriage along the guide, wherein at least one gear of the multistage transmission rotates about an axis that is generally perpendicular to both the longitudinal axis of the housing and a transverse axis of the housing.

5. The portable body massager of claim 4 wherein a stationary component of the multistage transmission is mounted to the housing.

6. The portable body massager of claim 4 wherein all moving components of the multistage transmission are supported upon the carriage.

7. The portable body massager of claim 1 farther comprising:

a worm mounted to and driven by the motor output shaft;

a worm gear rotatably mounted to the carriage and operably driven by the worm;

a pinion gear rotatably mounted to the carriage and operably driven by the worm gear; and a longitudinal rack affixed to the housing and engaged with the pinion gear such that rotation of the pinion gear translates the carriage along the guide.

8. The portable body massager of claim 1 wherein the operation of the first motor further comprises user-selected rotation for translating the carriage to a desired longitudinal orientation.

9. The portable body massager of claim 1 wherein the operation of the first motor further comprises continuous rotation within a range of the carriage for providing a massage effect from the at least a pair of massage members.

10. The portable body massager of claim 9 wherein the operation of the first motor is controlled from a control pad.

11. The portable body massager of claim 9 wherein the second motor is in operable communication with the at least a pair of massage members for continuously rotating the at least a pair of massage members relative to the carriage for providing the rotary kneading effect as the at least a pair of massage members are being translated longitudinally.

12. The portable body massager of claim 1 wherein the operation of the second motor is controlled from a control pad.

13. The portable body massager of claim 1 wherein the operation of the second motor further comprises continuous rotation for providing a continuous rotary kneading effect of the at least a pair of massage members.

14. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a first motor supported upon the carriage, the first motor having a motor output shaft driven thereby, the motor output shaft being operably coupled to the housing to translate the carriage along the guide;

at least a pair of massage members transversely spaced about the longitudinal axis, each of the at least a pair of massage members being supported by the carriage for rotation relative to the carriage for imparting a massage effect upon the portion of the user's body as the carriage is translated relative to the housing; and a second motor supported upon the carriage in operable communication with the at least a pair of massage members for rotating the at least a pair of massage members relative to the carriage;

wherein the user can control the operation of the first and second motors to provide:

a rolling massage effect at a stationary width of the at least a pair of massage members resulting from continuous operation of the first motor and no operation of the second motor, a rolling massage effect with width adjustment resulting from continuous operation of the first motor and user-selected operation of the second motor, a rotary kneading massage effect resulting from continuous operation of the second motor, a rotary kneading massage effect with longitudinal adjustment resulting from continuous operation of the second motor and user-selected operation of the first motor, and a rotary kneading massage effect upon a length of the user's body resulting from continuous operation of the first and second motors.

15. A portable body massager sized to be received and supported by a conventional chair, the massager comprising:

a portable housing sized to be received and supported by a backrest of the conventional chair, the housing having a longitudinal axis and an external contact surface for receiving a portion of a body of a user;

a longitudinal guide mounted in the housing;

a carriage oriented in the housing and cooperating with the guide for limited longitudinal translation in the housing along the guide;

a first motor supported by one of the carriage and the housing, the first motor having a motor output shaft driven thereby, the motor output shaft being operably coupled to the other of the carriage and the housing to translate the carriage along the guide;

at least a pair of massage members transversely spaced about the longitudinal axis, each of the at least a pair of massage members being supported by the carriage for rotation relative to the carriage for imparting a massage effect upon the portion of the user's body as the carriage is translated relative to the housing; and a second motor in operable communication with the at least a pair of massage members for adjusting the width of the at least a pair of massage members relative to the carriage:

wherein the user can control the operation of the first and second motors to provide a rolling massage effect at a stationary width of the at least a pair of massage members resulting from continuous operation of the first motor and no operation of the second motor; and wherein each of the at least a pair of massage members further comprises:

a bracket rotatably mounted to the carriage, a primary massage node rotatably mounted to the bracket about an axis of rotation that is not coaxial with an axis of rotation of the bracket, so that the primary massage node can rotate relative to the bracket to provide a rolling massage effect, and a secondary massage node rotatably mounted to the bracket about an axis of rotation that is not coaxial with the axis of rotation of the bracket and the axis of rotation of the primary massage node, so that the secondary massage node can rotate relative to the bracket to provide a rolling massage effect, the secondary massage node being smaller than the primary massage node so that the rolling massage effect of the secondary massage node differs from that of the primary massage node.

16. The portable body massager of claim 15 wherein the user can control the operation of the first and second motors to provide:

a rolling massage effect with width adjustment resulting from continuous operation of the first motor and user-selected operation of the second motor, a kneading massage effect resulting from continuous operation of the second motor, a kneading massage effect with longitudinal adjustment resulting from continuous operation of the second motor and user-selected operation of the first motor, and a kneading massage effect upon a length of the user's body resulting from continuous operation of the first and second motors.

17. The portable body massager of claim 15 wherein the operation of the second motor further comprises continuous operation for providing a continuous kneading massage effect of the at least a pair of massage members.

18. The portable body massager of claim 15 wherein the first motor is supported upon the carriage and the motor output shaft is operably coupled to the housing.

19. A massage device comprising:

housing;

a guiding device comprising a plurality of guiding rails positioned in a middle region of the housing; and a carriage which is suspended above the guiding rails of the guiding device, and which further comprises a bottom and a cover plate covered on the bottom;

wherein the further comprises:

a massage system mounted on the cover plate of the carriage, a first transmission system to move the carriage along the guiding rails of the guiding devices, and a second transmission system for driving the massage system, both the first and second transmission systems being contained between the carriage and the cover plate;

wherein the massage system farther comprises at least one rotation massage bracket which has a middle shaft bore defined therein and which has at least one kneading head mounted thereon;

wherein the second transmission system further comprises a second motor, a second worm mechanically connected with the motor, at least one second worm gear meshing with the second worm and a worm gear shaft coaxially connected with the at least second worm gear; and wherein the worm gear shaft of the second worm gear has its top end mounted in the middle shaft bore of the rotation massage bracket of the massage system, the rotation massage bracket with its kneading head being rotated by the worm gear shaft.

20. The massage device as claimed in claim 19, wherein the housing has a rack provided therein, and the first transmission system further comprises a first motor, a first worm mechanically connected with the first motor, a first worm gear meshing with the first worm, a first pinion gear mounted to the first worm gear, a first reduction gear meshing with the first pinion gear, a second reduction gear meshing with the first reduction gear, and a second pinion gear meshing with the rack of the base cover.

21. The massage device as claimed in claim 20, wherein the first and second motors are set in a certain angle.

22. The massage device as claimed in claim 19, wherein the carriage further comprises a power cord mounted between the bottom and the cover plate.

23. The massage device as claimed in claim 19, wherein the number of the second worm gears of the second transmission system is two, the two second worm gears being simultaneously driven by the second worm, and the number of the massage brackets of the massage system is two, the worm gear shafts having their top ends mounted in the middle shaft bores of the respective massage brackets.

24. The massage device as claimed in claim 19, wherein the number of the kneading heads of the rotation massage bracket is two, and the kneading heads are symmetrically mounted on both sides of the middle shaft bore of the rotation massage bracket.

25. The massage device as claimed in claim 24, wherein the kneading heads are of a mushroom-shape.

* * * * *

UNITED STATES PATENT AND TRADEMARK OFFICE

CERTIFICATE OF CORRECTION

PATENT NO. : 7,470,242 B2
APPLICATION NO. : 11/205949
DATED : December 30, 2008
INVENTOR(S) : Roman Ferber et al.

It is certified that error appears in the above-identified patent and that said Letters Patent is hereby corrected as shown below:

Column 9, Line 4, Claim 7:
Delete “farther” and insert -- further --.

Column 11, Line 17, Claim 19:
Before “housing” insert -- a --.

Column 11, Line 23, Claim 19:
Before “further” insert -- carriage --.

Column 11, Line 27, Claim 19:
Delete “devices” and insert -- device --.

Column 11, Line 32, Claim 19:
Delete “farther” and insert -- further --.

Signed and Sealed this

Seventeenth Day of February, 2009

JOHN DOLL
*Acting Director of the United States Patent and Trademark Office*